United States Patent [19]

Singh

[11] 4,039,392

[45] Aug. 2, 1977

[54] PROCESS AND APPARATUS FOR PRODUCING CHAR AND CO-PRODUCTS FROM COAL AND THE LIKE

[76] Inventor: Alamjit D. Singh, P.O. Box 1679, Chicago, Ill. 60690

[21] Appl. No.: 580,561

[22] Filed: May 27, 1975

Related U.S. Application Data

[63] Continuation of Ser. No. 403,423, Oct. 4, 1973, abandoned, which is a continuation-in-part of Ser. No. 175,932, Aug. 30, 1971, abandoned.

[51] Int. Cl.[2] ..... C10B 1/04

[52] U.S. Cl. ..... 202/93; 202/120; 201/12; 201/13; 201/17; 201/28; 201/22; 48/202

[58] Field of Search ..... 201/27–34, 201/17, 36–38, 12–16, 20, 21, 22, 44; 202/120, 121, 124, 91, 93, 85, 86; 208/127; 48/206, 210, 202–204

[56] References Cited

U.S. PATENT DOCUMENTS

| | | | |
|---|---|---|---|
| 2,657,987 | 11/1953 | Barr | 201/31 |
| 2,662,816 | 12/1953 | Kalbach | 48/202 |
| 2,734,851 | 2/1956 | Smith | 201/31 |
| 2,741,549 | 4/1956 | Russell | 201/31 |
| 3,437,562 | 4/1969 | Singh | 201/22 |
| 3,598,528 | 8/1971 | Franz et al. | 201/17 |
| 3,661,543 | 5/1972 | Saxton | 201/31 |
| 3,694,346 | 9/1972 | Blaser et al. | 201/44 X |
| 3,734,833 | 5/1973 | Singh | 201/17 |

*Primary Examiner*—Wilbur L. Bascomb, Jr.
*Attorney, Agent, or Firm*—Olson, Trexler, Wolters, Bushnell & Fosse, Ltd.

[57] ABSTRACT

In accordance with the present invention an apparatus and process are disclosed wherein coal or peat or lignite is first transmitted to a devolatilizer from which tar and fuel gas are removed for transmission to a separator and recovery system, from which by-products are obtained and sulphur-free fuel gas is transmitted to the steam boiler. Char is recirculated between the devolatilizer and a heat generator. In one form of the invention a fraction of the char discharge from the devolatilizer is transmitted to a gasifier for gasification and complete sulphur extraction, and another fraction in readily combustible form is transmitted to the steam boiler for use. In another form of the invention the complete output of the devolatilizer is transmitted to the gasifier wherein a fraction is gasified and another fraction is transmitted to the steam boiler. The proportion of the fractions may be controlled to thereby control the overall sulphur emission of the system.

8 Claims, 4 Drawing Figures

PROCESS AND APPARATUS FOR PRODUCING CHAR AND CO-PRODUCTS FROM COAL AND THE LIKE

REFERENCE TO RELATED APPLICATION

Figure 1:
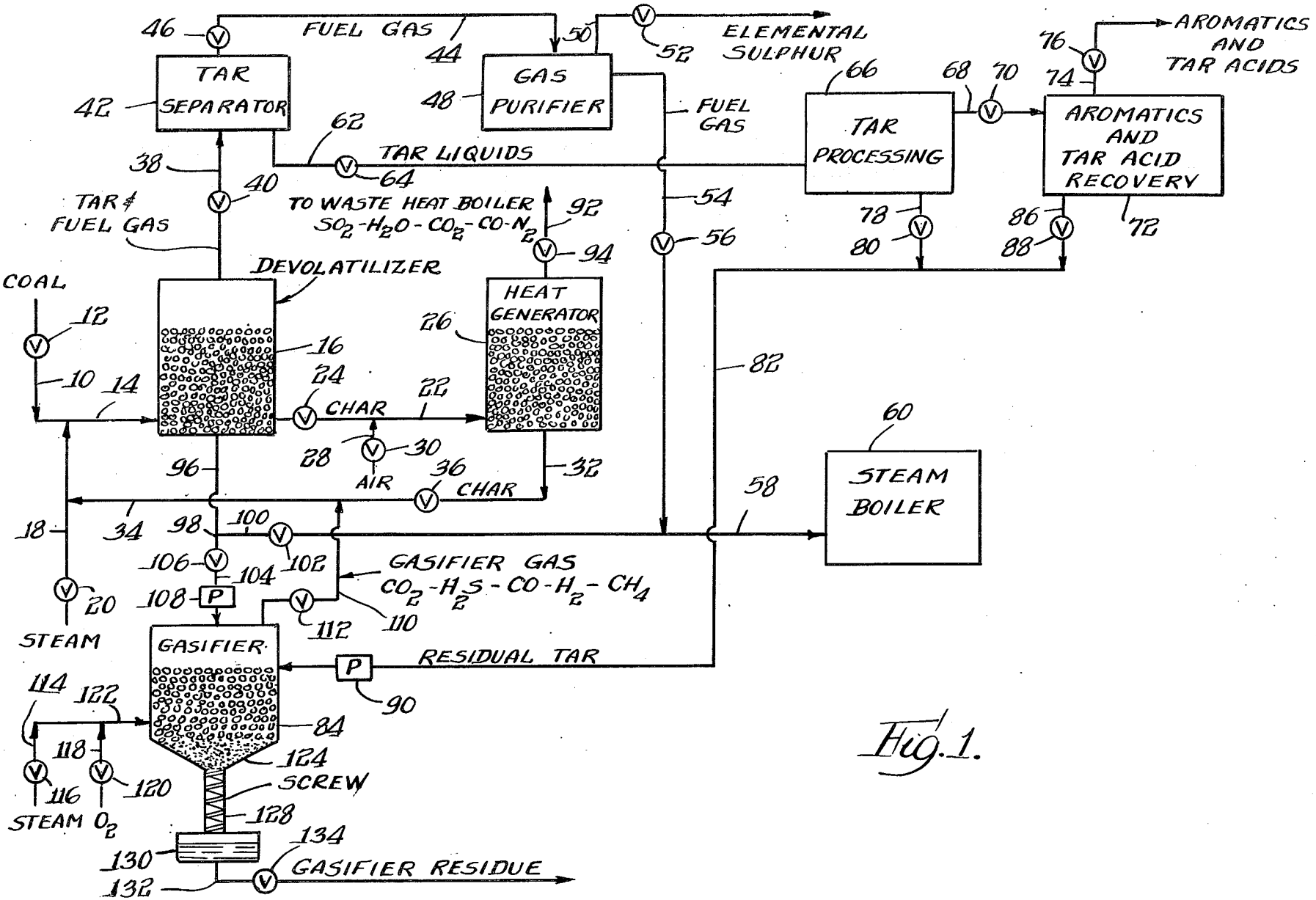

This application is a continuation of United States patent application Ser. No. 403,423, filed Oct. 4, 1973 now abandoned which is a continuation-in-part of my copending application Ser. No. 175,932, filed Aug. 30, 1971, now abandoned entitled "Process and Apparatus for Producing Char and Co-Products from Coal and the Like."

This invention relates to the conversion of energy, and concerns particularly the production of fuel and related co-products from coal and the like.

In the production of power from fuels, a major problem has been pollution. In the burning of coal, a particular problem has been atmospheric pollution from the oxides of sulphur. As a result, in many instances relatively high sulphur coal has been rendered unusable because of inability to comply with Governmental regulations or other requirements concerning the emission of sulphur dioxide into the atmosphere.

In my prior U.S. Pat. No. 3,437,562, dated Apr. 8, 1969, and entitled "Process for Producing Combined Coal Char and Oil Coke and Co-Products Therewith" a process is disclosed for producing char from coal and oil, which char may be advantageously burned in the production of power, while at the same time imparting to the char a relatively lower sulphur content, whereby to provide for a reduced emission of sulphur dioxide into the atmosphere when the char is burned in the generation of power. Co-products or by-products are recovered as an incident to the process, for economic enhancement, and char which is a carbonaceous product of both coal and oil, is formed.

While the process thus set forth is economically attractive, in certain instances for geographical or other reasons, oil in substantial quantities may not be available. In accordance with the present invention, a char may be produced from coal alone, which has a lower sulphur content and desirable burning characteristics; and at the same time the char is formed, co-products or by-products are produced in substantial quantities for economic enhancement. In general, the process provides for the production of char from coal, in a manner having improved economy of operation and which produces a char having good burning characteristics; and the sulphur content of the char produced may be varied and controlled within relatively wide limits to conform with Governmental regulations and other sulphur emission requirements as may be involved. As will be understood, the term "coal" as herein used, is in its generic sense, including the lower grades of coal often referred to as peat or lignite.

Processes are known for the gasification of coal. During such gasification process, the coal may be essentially entirely gasified, except for a residue comprising primarily ash, and the gaseous discharge from the gasifier may be separated, and treated, and burned; the coal by such means comprising a fuel from which a relatively low discharge of sulphur into the atmosphere may be achieved. However, in such total gasification of the coal, valuable by-products are lost, and overall thermal efficiency is low, and costs are high, whereby the gas output from the gasifier, used as fuel, under current market conditions costs approximately twice the cost of natural gas. Thus the economic use of such gasified coal in the production of fuels has been relatively inhibited.

In accordance with the process of the present invention is one form, stated generally, the coal is initially transmitted to a "Devolatilizer" wherein the coal is treated to obtain therefrom valuable co-products or by-products; and the char discharge from the devolatilizer is divided into essentially two flow streams, one of which is transmitted to a coal "Gasifier" wherein essentially complete gasification takes place, and the other of which is transmitted, as char, to the steam boiler or other station of storage or use. By this means by-products from the coal, normally lost in coal gasification, are recovered for economic enhancement, and the relatively high cost operation of the "Gasifier" becomes a factor in respect to only a proportion of the coal. The reactivity of the char which is transmitted to the boiler is not impaired. Sulphur may be extracted from the gasifier output, and by adjustment and proportioning of the flow streams, the overall sulphur emission from the process may be varied and controlled.

In another form of the invention, the entire output of the devolatilizer is transmitted to the gasifier, but only a portion of the product within the gasifier is gasified, the remainder being transmitted as a properly combustible char to the boiler or point of use.

In the process and apparatus of the present invention, the foregoing is achieved by utilizing with the devolatilizer and the gasifier, a "Heat Generator" which maintains a proper thermal balance, and provides for the proper functioning of the devolatilizer.

It is thus an object of the present invention to provide a process for converting coal into fuel, wherein an improved measure of economically valuable by-products may be obtained, and wherein there will be a reduced overall sulphur emission from the fuel, as burned, which sulphur in amounts may be varied and controlled; and wherein the process provides a maximum of economy in the production and burning of the fuel, and a char which has satisfactory burning characteristics.

Various other objects, advantages and features of the invention will be apparent from the following specification, when taken in connection with the accompanying drawings wherein certain preferred embodiments of the invention are set forth for purposes of illustration.

In the drawings, four different species of the invention are set forth in FIGS. 1–4.

Referring more particularly to the drawings, reference is first made to the embodiment set forth in partially diagrammatic form in FIG. 1.

Coal, preferably in granular form, and which as previously stated may be of various types and kind including peat and lignite, may be introduced into the system from a suitable source of supply through a conduit indicated by the reference numeral 10, controlled by a suitable valve 12. The coal is transmitted to the "Devolatilizer" through a conduit, as indicated at 14.

The devolatilizer, indicated by the reference numeral 16, may be of the general type and kind shown in my said prior U.S. Pat. No. 3,437,562, which includes provision for the introduction of suitable fluidizing and stripping media. In FIG. 1, such fluidizing media is indicated as steam, introduced into the conduit 14 through a supply conduit 18, under control of a valve diagrammatically indicated at 20. Within the devolatilizer the coal is subjected to a heat treatment, whereby reaction occurs to recover therefrom economically valuable by-products, by means and methods which presently will be more clearly understood.

More particularly, a portion of the discharge from the devolatilizer, indicated as "Char" is transmitted by means of a conduit 22, under control of a valve 24, to a "Heat Generator," indicated by the reference numeral 26. Air is also introduced into the heat generator, in FIG. 1 the air being shown as being introduced into the conduit 22 from a supply conduit 28, under control of a valve 30.

Within the heat generator, a partial burning of the char takes place, and in a representative embodiment the temperature within the heat generator may be on the order of 1200° F. to 1400° F.

Char from the heat generator may be circulated back to the devolatilizer, through conduits 32 and 34, under control of a valve 36. The conduit 34 discharges into the conduit 18, the char from the heat generator thus being recirculated to the devolatilizer along with the steam within the conduit 18. The temperature within the devolatilizer will be somewhat lower than the heat generator, within the general range from 800° F. to 1200° F., and in a representative embodiment on the order of 950° F.

Substantial quantities of tar and fuel gas are discharged from the devolatilizer, through a line 38 controlled by a valve 40, to a "Tar Separator" diagrammatically indicated at 42. The fuel gas discharged from the tar separator is transmitted by a conduit 44, under control of a valve 46, to a "Gas Purifier," diagrammatically indicated at 48. Within the gas purifier the sulphur is removed from the fuel gas, and elemental sulphur is discharged and recovered, as indicated, through the discharge conduit 50 under control of a valve 52. The sulphur-free fuel gas is discharged from the gas purifier through a conduit 54, under control of a valve 56, to be thereby transmitted through a conduit 58 to a steam boiler, or other point of storage or use, indicated by the reference numeral 60. The fuel gas transmitted to the steam boiler, to be burned, is substantially sulphur-free.

The tar liquids, discharged from the tar separator 42, are transmitted by a conduit 62, under control of a valve 64, to a "Tar Processing" vessel, diagrammatically indicated by the reference numeral 66. In the tar processing vessel aromatics and tar acids are separated, and discharged by means of a conduit 68, under control of a valve 70, to a vessel or station for the recovery of aromatics and tar acids, as indicated by the reference numeral 72. Within the vessel 72 the aromatics and tar acids are further separated, and transmitted by means of a conduit 74, under control of a valve 76, to a point of discharge at which they may be further treated, stored and used.

Residual tar from the tar processing vessel 66, is transmitted by means of a conduit 78, under control of a valve 80, to a conduit 82, which leads to a "Gasifier," as will be presently described. Similarly the residual tar which is obtained from the aromatics and tar acid recovery chamber 72, is transmitted to the conduit 82 from a conduit or discharge line 86 under control of a valve 88, which discharges from the chamber 72.

The gasifier operates at relatively high pressure, for example on the order of 500–1000 psi, and accordingly the residual tar from the conduit 82 must be transmitted into the gasifier by means of a pump, as indicated at 90. In the system of FIG. 1, the devolatilizer and the heat generator are operable at low pressure, for example on the order of 15–35 psi, sufficient only to insure transmission through the various conduits, as heretofore described. Thus in the system of FIG. 1, the devolatilizer and heat generator may be relatively lower cost vessels, and only the gasifier must be of sufficient structural strength to withstand high pressure.

Referring further to the system as shown in FIG. 1, certain gases will be discharged from the heat generator, and these are indicated as being discharged through a conduit 92 under control of a valve 94; and the discharged gases are indicated as comprising $SO_2$; $H_2O$; $CO_2$; CO and $N_2$. These gases may be discharged to atmosphere, or preferably first to a "waste heat boiler" wherein the CO, which is combustible, is burned and its thermal energy thereby obtained. While $SO_2$ is thus emitted to the atmosphere from the heat generator, either directly, or through the intermediary of the waste heat boiler, the amount so emitted comprises only a small fraction of the total which would normally be emitted if the total coal were burned, and in a representative embodiment may be on the order of 10%. If desired, the discharge gases from the heat generator may be treated with limestone or dolomite for the removal of the $SO_2$.

Referring further to the devolatilizer, the output therefrom which is not circulated through the heat generator, is transmitted as char through a discharge conduit 96 to a discharge point 98, at which point the discharge is separated, and one desired proportion is transmitted through a conduit 100, controlled by a valve 102, connecting to the conduit 58 leading to the steam boiler 60, to be used as fuel. The other predetermined fraction of the char discharge, is transmitted from the separation point 98 through a conduit 104, under control of a valve 106, and by means of a pump 108 is delivered into the gasifier 84 to be gasified therein.

The gasifier 84 may be of known conventional structure, and within the gasifier, the char delivered thereto is gasified, substantially completely, and the gases are discharged through a conduit 110 under control of a valve 112. The discharged gases will be predominantly $CO_2$; $H_2S$; CO; $H_2$; and $CH_4$. These discharged gases are introduced into the conduit 34, to be transmitted back to the devolatilizer 16. Within the devolatilizer, reaction occurs between the gasifier gases and the incoming coal, and the char recirculated from the heat generator. The $H_2$ from the gasifier reacts with the sulphur in the coal, and in the char, within the devolatilizer, forming $H_2S$, which is transmitted as fuel gas to the tar separator 42, as previously described; and from the fuel gas the sulphur is removed within the gas purifier 48, as also previously described, whereby substantially sulphur-free fuel gas is transmitted through the conduits 54 and 58 to the steam boiler.

It will thus be seen that the char increment which is transmitted to the gasifier reaches the boiler 60 as fuel in gaseous form, essentially sulphur-free. Thus an increase of char to the gasifier results in a reduction of sulphur in the fuel overall. That increment of the char which is transmitted from the devolatilizer to the boiler is brought to the combustion zone as high volatile, low ash, char which is readily combustible in high combustion furnaces. The volatiles are not impaired such as may result from partial gasification, or if the char is treated with dolomite by the "acceptor method," both of which involve the use of high temperature with resultant impairment of the burning qualities of the char.

Steam is introduced into the gasifier from a supply line 114 under control of a valve 116; and $O_2$ is introduced into the gasifier from a supply line 118 under control of a valve 120. Both conduits 114 and 118 lead to a conduit 122 which in turn leads to the reaction chamber of the gasifier. The gasifier includes an ash collection chamber or section 124 from which a conveyor screw 126 transmits the gasifier residue which will be primarily ash into a water tank 130 for cooling, from which the gasifier residue is transmitted through a conduit 132 under control of a valve 134, to a point of discharge.

In a representative embodiment, the temperatures within the gasifier may be on the order of 1900° F., or higher.

In summary, it will be seen that by reason of the system and process provided, within the devolatilizer an effective evolution of tar and fuel gas occurs, the fuel gas being treated for sulphur removal, whereby to provide a substantially sulphur-free fuel for the steam boiler; while the tar recovery provides by-products of commercial value, for maximum economic efficiency. The heat generator functions to maintain the devolatilizer in proper thermal balance, and $H_2$ is transmitted to the devolatilizer from the gasifier, to aid in the sulphur removal process. The sensible heat of the gases from the gasifier are also recaptured in the devolatilizer. Air is introduced into the heat generator but not into the devolatizer. By this means air does not contact the coal until the volatiles have been removed. Thus heat is supplied to the devolatilizer from the heat generator without the use of air in the devolatilizer.

From the devolatilizer the discharge may be separated at the point 98 into desired proportionate fractions, one fraction of the char being transmitted directly to the steam boiler for combustion, while the other fraction is transmitted to the gasifier 84. The fraction which is transmitted to the gasifier is subjected to substantially complete gasification, with the resultant removal of the sulphur therefrom; whereas the fraction of the char which is transmitted to the steam boiler retains its ready combustibility; and the fractions of the char transmitted to the steam boiler and to the gasifier may be adjusted and controlled so as to meet Governmental regulations and the sulphur requirements of the particular system or installation of use. By the transmission of a portion only of the char from the devolatilizer to the gasifier, the relatively high cost gasifier operation is minimized; and furthermore, by gas transmission back from the gasifier to the devolatilizer, not only is the sensible heat of the gases discharged at high temperature recovered within the devolatilizer, but at the same time the $H_2$ which is transmitted to the devolatilizer is utilized in the sulphur-removal process therein.

Within the gasifier the residual tar is gasified, so that this fraction of the product is utilized as well.

Figure 2:
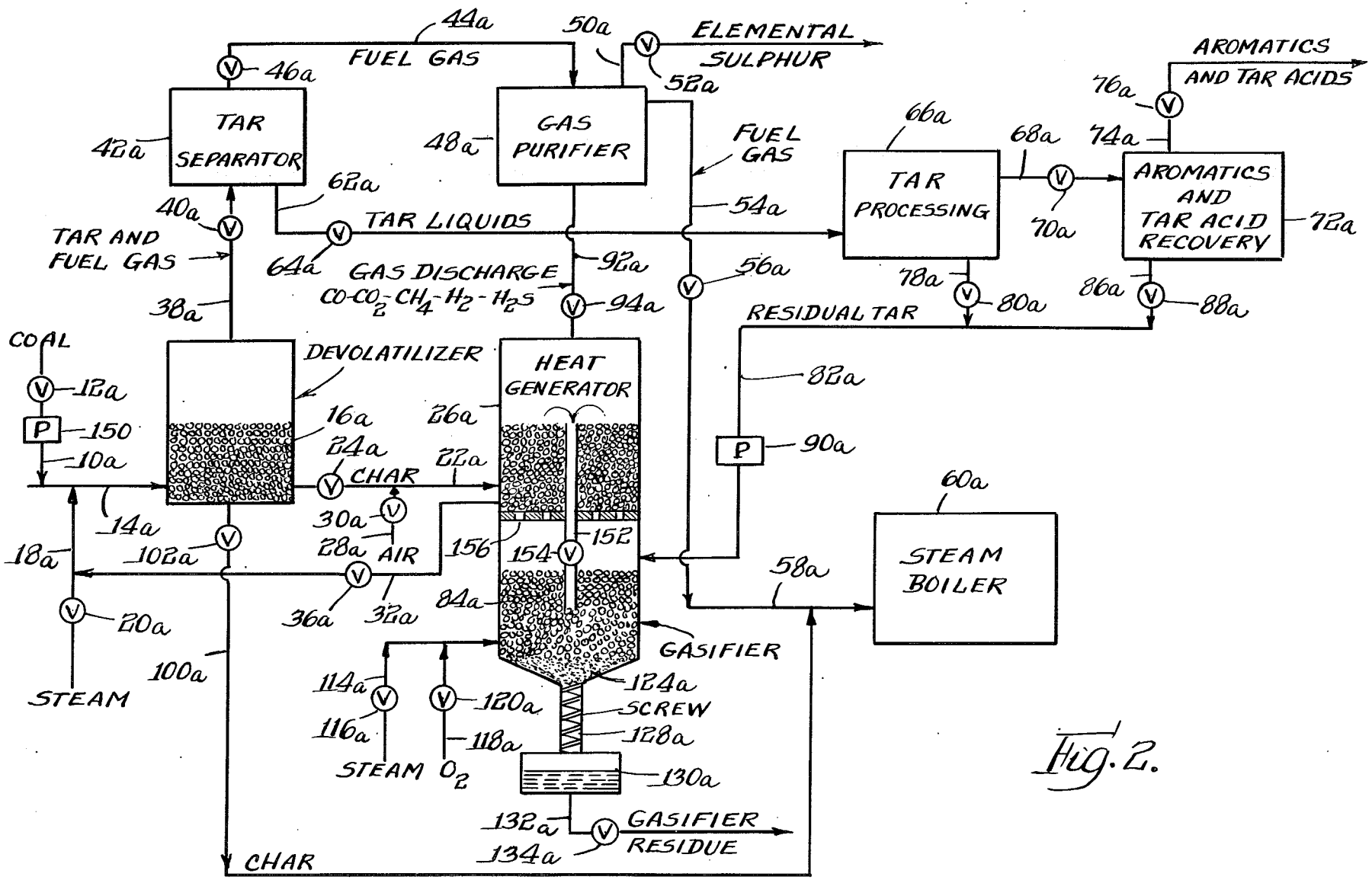

In FIG. 2, a processing system is set forth, generally similar to that previously described with reference to FIG. 1, except that the heat generator and gasifier are incorporated into a single vessel. Another difference is that the gases discharged from the heat generator are transmitted to the gas purifier components of the system.

Many of the components of the system of FIG. 1, are present in the system of FIG. 2, and are indicated by the same reference numerals, with the suffix "*a*", and need not be specifically described.

Thus it will be seen that the transmission of the coal and the steam to the devolatilizer **16*a* is essentially as in the previously described embodiment. However, inasmuch as the devolatilizer in this instance is operable at high pressure substantially the same as that within the gasifier, a pump as indicated at 150 is interposed in the supply line 10*a***.

Char is circulated between the devolatilizer and the heat generator by means of conduits **22*a* and 21*a***, as previously described.

The tar and fuel gas are transmitted from the devolatilizer through the conduit **38*a***, to a separating and recovery system, also as previously described.

The gasifier functions as in the previously described embodiment, being supplied with steam through a conduit **114*a*, and with $O_2$ through a conduit 118*a*; and with a discharge screw 128*a***, as previously set forth.

In the embodiment of FIG. 2 the division of the char between that which is transmitted to the steam boiler for burning, and that which is transmitted to the gasifier for gasification, occurs directly within the heat generator chamber. As shown, an overflow pipe or conduit 152, controlled by a valve 154, is provided within the heat generator, whereby a predetermined fraction of the char within the heat generator is transmitted to the gasifier or gasifier section of the vessel, as indicated at **84*a*. This section receives the residual tar from the conduit 82*a*, through the intermediary of pump 90*a***, in a manner as previously described.

The discharge gases from the gasifier are transmitted through the upper chamber of the heat generator, through a foraminous element 156; reaction occurs within the heat generator chamber, and as previously stated, the gaseous discharge from the heat generator through the conduit **92*a*, is in this instance transmitted to the gas purifier 48*a***. The gases in this instance may comprise primarily CO; $CO_2$; $CH_4$; $H_2$; and $H_2S$. There will be substantially no $SO_2$.

Through the control of the valve 154, the amount of char transmitted to the gasifier may be predetermined and controlled, the non-gasified fraction of char being transmitted through conduit **32*a* to the devolatilizer, from which the char to the steam boiler is transmitted through conduit 100*a* under control of valve 102*a***, in a manner as previously described.

As previously mentioned, in this instance the devolatilizer, and also the heat generator as well as the gasifier are operable at high pressure, on the order of 500–1000 psi, and thus the devolatilizer and heat generator vessels must be constructed to withstand the higher pressure. The temperatures therein may be on the order as previously described.

It will be seen that the system and process of FIG. 2, function in a manner, and provide the advantages and features, as heretofore discussed with reference to the embodiment of FIG. 1.

Figure 3:
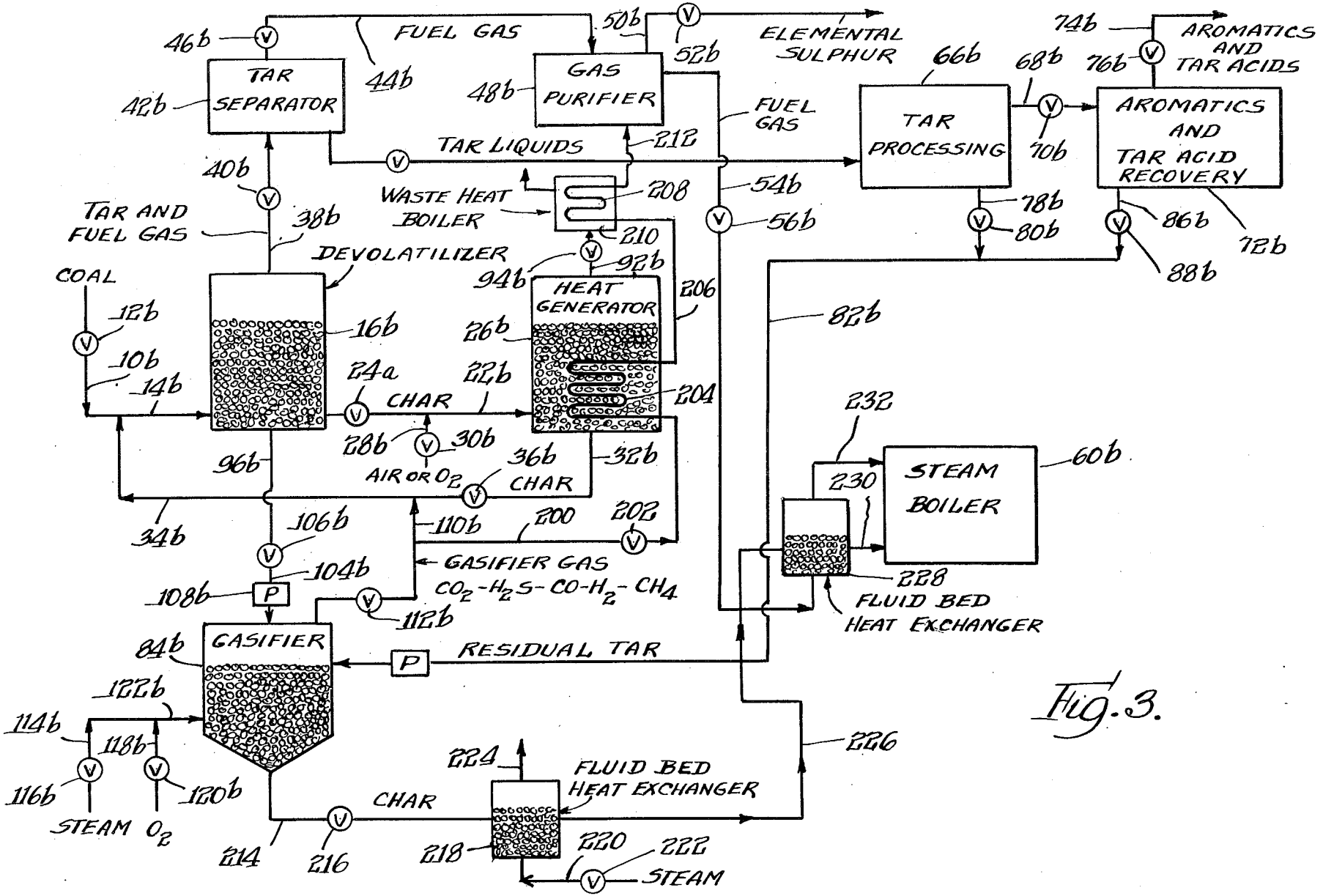

In FIG. 3 a further form of the invention is shown, the structure being similar to FIG. 1, except that in this instance the entire output of the devolatilizer is transmitted to the gasifier, and only a portion of the product converted into gas therein, the remainder being transmitted as char to the steam boiler; but the char being so constituted and treated as to be readily combustible therein. In FIG. 3 parts corresponding to FIG. 1 have been designated with similar reference numerals, together with the suffix *b*.

The feed to the devolatilizer is the same as previously described with reference to FIG. 1, except that the input steam has been eliminated, the output of the gasifier being relied upon to provide a fluidized bed within the devolatilizer, as will presently appear.

From the devolatilizer char is transmitted to the heat generator through conduit 22*b*, as previously described with reference to FIG. 1. From the heat generator, into which air is introduced by means of conduit 28*b*, the hot char is transmitted back to the devolatilizer by means of conduit 32*b*, also as previously described.

The gaseous components from the devolatilizer are transmitted through conduit 38*b* to the tar separator and fuel gas system as previously described.

The rest of the solids from the devolatilizer pass by means of conduit 96*b* under control of valve 106*b* and pump 108*b* to the gasifier 84*b* which in this instance receives the entire output from line or conduit 96*b*. Steam and $O_2$ are supplied to the gasifier through the conduit 122*b*, also as previously described.

The output gas from the gasifier is transmitted through line 110*b* to conduit 34*b*, so as to supply a fluidized bed to the devolatilizer, along with sensible heat, and a supply of $H_2$ for the conversion of sulphur within the devolatilizer into $H_2S$ as previously described in connection with the embodiment of FIG. 1.

However, in this instance another portion of the gasifier gas is bypassed or transmitted by means of a conduit 200 under control of a valve 202 through a heating coil 204 within the heat generator, whereby to extract sensible heat from this portion of the gasifier gas, and so as to relieve or reduce the necessary heat load of the heat generator by combustion of products therein. From the heat coil 204 the gasifier gas continues on through conduit 206 to a second heat coil 208 within the waste heat boiler, indicated by the numeral 210. From the waste heat boiler the gasifier gas continues through conduit 212 to the gas purifier 48*b*. By this means the sensible heat of the gasifier gas, which initially is at high temperature, is utilized to a maximum extent.

In the embodiment of FIG. 3 preferably a portion only of the product within the gasifier is gasified, the remainder being transmitted, as char, through a conduit 214 under control of a valve 216 to the steam boiler. However, the char from the gasifier is first transmitted to a first fluid bed heat exchanger 218 where a part of the heat is extracted therefrom by steam transmitted to the heat exchanger through a conduit 220 under control of a valve 222. At the same time the steam delivered from the heat exchanger, as through a conduit 224, may be utilized as superheated steam in the system, for example supplied to the gasifier through the conduit 114*b* and conduit 122*b*, as previously described. The char, thus reduced in temperature, continues on through conduit 226 to a second fluid bed heat exchanger 228 wherein its temperature is further reduced by contact with the fuel gas from conduit 54*b*, which may be substantially at room temperature. By this means, the char as ultimately introduced into the steam boiler through conduit 230 has a sufficiently low temperature so that it may be advantageously burned within the steam boiler by conventional combustion apparatus.

By controlling the proportion of gasification within the gasifier 84*b*, the objective discussed in connection with the embodiment of the invention of FIG. 1 are achieved. And also, the proportion of the product from the gasifier which is transmitted from it as char through conduit 214, is so treated in the fluid bed heat exchangers 218 and 228 that it may be properly handled, and subjected to combustion within the steam boiler, as shown at 60*b*. Correspondingly, the fuel gas transmitted to the steam boiler, through conduit 232, will have its temperature correspondingly increased minimizing thermal shock of the combustion apparatus within the steam boiler in its reception of both of the desulphurized fuel gas and the char.

Figure 4:
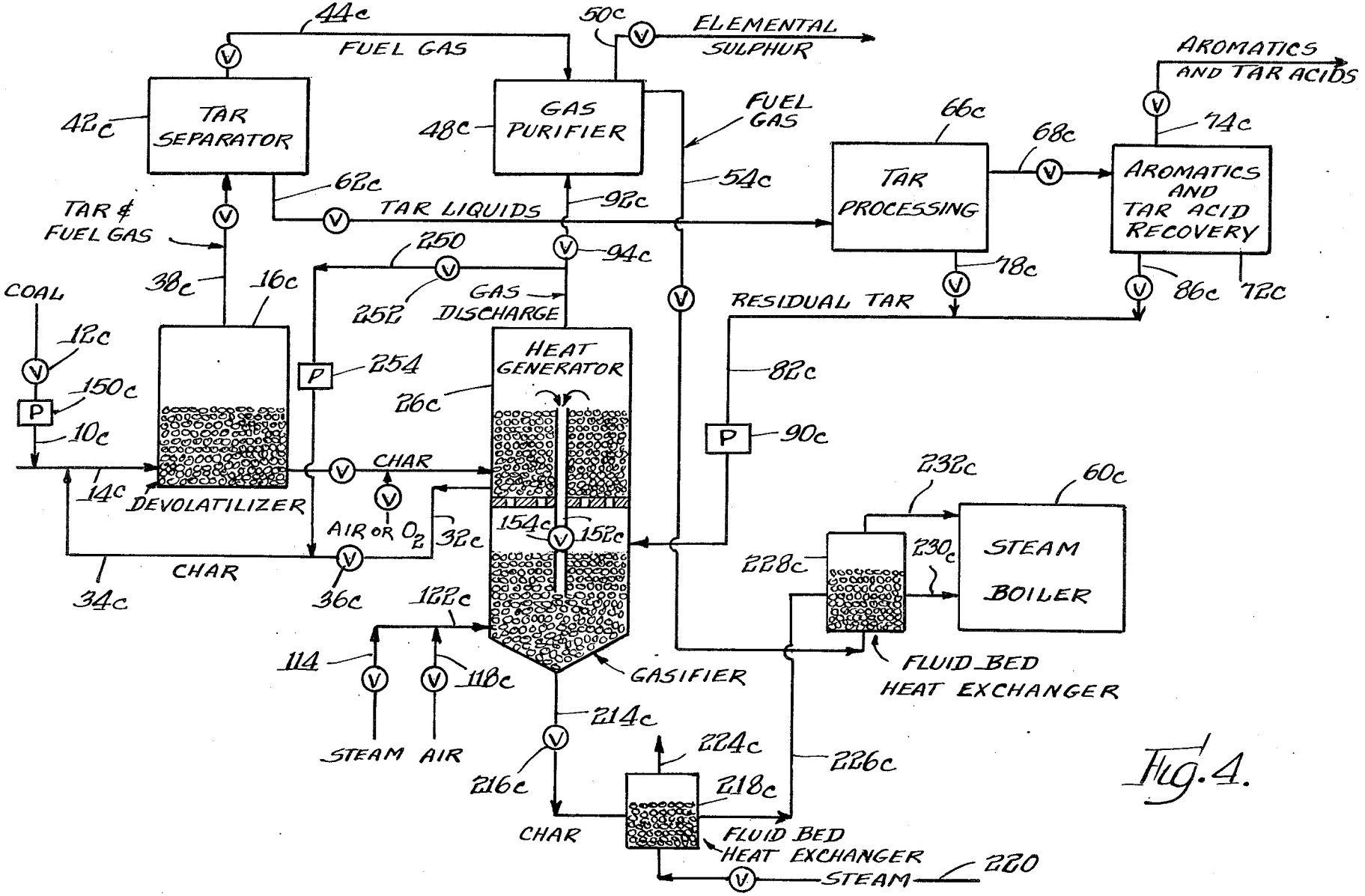

In FIG. 4, an embodiment of the invention is shown, generally similar to the apparatus of FIG. 2, but incorporating the structures essentially as previously described with reference to the embodiment of FIG. 3. Again corresponding parts are designated by corresponding reference numerals, with the suffix c.

It is believed that the operation of this form of the invention, and its features and advantages, will be clear from the drawing, FIG. 4, taken in connection with what has been previously set forth. To return a portion of the gas discharge from the gasifier, after it has passed through the heat generator for the extraction of sensible heat, a bypass line 250 is provided, under control of a valve 252, leading to the line or conduit 34*c* for transmission to the devolatilizer as previously described with reference to the embodiment of the invention shown in FIG. 3. Line 250 further includes a high temperature pump as indicated at 254 to insure proper gas flow.

The invention is hereby claimed as follows:

1. Apparatus for producing char from coal comprising a chamber forming a devolatilizer, means for introducing coal into the devolatilizer, means to produce a char in the devolatilizer, a chamber forming a heat generator, means for transmitting char from the devolatilizer to the heat generator, means for burning char in the heat generator at a controlled rate to thereby determine the temperature of the char, means for transmitting char at said controlled temperature from the heat generator into the coal introducing means, for transmission with the coal to the devolatilizer, said devolatilizer and heat generator forming a char interchange system, a gasifier, means for transmitting char from said interchange system to the gasifier, means for transmitting char from the gasifier, means for extracting volatiles including fuel gas from the devolatilizer, processing means for extracting sulphur from the fuel gas, and means for mixing at least a portion of the processed fuel gas with the char from the gasifier to provide a reduced sulphur combustion product for transmission to a station for use.

2. Apparatus for producing char from coal as defined in claim 1 wherein the heat generator and the gasifier are disposed within a single vessel.

3. Apparatus for producing char from coal as defined in claim 1 wherein a heat exchanger is provided for extracting heat from the gasifier char in its transmission to said station for use.

4. Apparatus for producing char from coal as defined in claim 1 wherein the means for extracting volatiles from the interchange system includes means for extracting tar, and processing means is provided for the tar to provide aromatics and tar acid recovery.

5. Apparatus for producing char from coal as defined in claim 1 wherein means is provided for transmitting gas from the gasifier to the interchange system.

6. Apparatus for producing char from coal as defined in claim 1 wherein the means for mixing the processed fuel gas and the char from the gasifier comprises a heat exchanger.

7. Apparatus for producing char from coal as defined in claim 1 wherein means is provided for extracting heat from the char from the gasifier prior to the mixing of the processed fuel gas therewith.

8. Apparatus for producing char from coal as defined in claim 4 wherein means is provided for transmitting residual tar from the tar processing means to the gasifier.

* * * * *